United States Patent [19]

Johne et al.

[11] Patent Number: 4,470,347

[45] Date of Patent: Sep. 11, 1984

[54] COMBINED WETTING AGENT-DISTRIBUTING SYSTEM FOR A PRINTING MACHINE

[75] Inventors: Hans Johne, Radebeul; Arndt Jentzsch, Coswig; Günter Schumann, Radebeul, all of German Democratic Rep.

[73] Assignee: VEB Kombinat Polygraph "Werner Lamberz" Leipzig, Leipzig, German Democratic Rep.

[21] Appl. No.: 424,957

[22] Filed: Sep. 27, 1982

[30] Foreign Application Priority Data

Nov. 30, 1981 [DD] German Democratic Rep. ... 235214

[51] Int. Cl.[3] ..... B41F 7/26; B41F 7/40

[52] U.S. Cl. ..... 101/148; 101/351

[58] Field of Search ..... 101/148, 147

[56] References Cited

U.S. PATENT DOCUMENTS

| | | | |
|---|---|---|---|
| 3,326,122 | 6/1967 | Wildeman | 101/148 |
| 3,673,959 | 7/1972 | Jesuit et al. | 101/148 |
| 3,701,316 | 10/1972 | Sylvester et al. | 101/148 |
| 3,749,011 | 7/1973 | Abendroth et al. | 101/148 |
| 3,842,735 | 10/1974 | Southam et al. | 101/148 |
| 3,890,898 | 6/1975 | Fischer | 101/148 |
| 3,911,815 | 10/1975 | Banfer | 101/148 |
| 4,127,067 | 11/1978 | Dahlgren et al. | 101/148 |

FOREIGN PATENT DOCUMENTS

| | | |
|---|---|---|
| 613043 | 5/1935 | Fed. Rep. of Germany . |
| 1093804 | 12/1960 | Fed. Rep. of Germany . |
| 117844 | 2/1975 | German Democratic Rep. . |

*Primary Examiner*—Edgar S. Burr
*Assistant Examiner*—M. J. Hirabayashi
*Attorney, Agent, or Firm*—Michael J. Striker

[57] ABSTRACT

A moistening system for a printing machine, which can be suitable for application to a printing roller either of a wetting agent or alcohol, comprises a fountain roller partially immersed in a reservoir containing an agent to be applied to the printing roller, a slip roller in contact with the fountain roller, a rubbing cylinder rotated with the speed of the printing machine and applying the agent to the impression roller through distributing rollers, and a vibrating roller interpositioned between the rubbing roller and the slip roller to transmit the agent from the slip roller to the rubbing roller. The slip roller is connected to the rubbing roller so that they rotate with the same velocity.

4 Claims, 2 Drawing Figures

COMBINED WETTING AGENT-DISTRIBUTING SYSTEM FOR A PRINTING MACHINE

BACKGROUND OF THE INVENTION

The present invention relates to a combined moistening system for a printing machine, which can be universally used for water moistening and alcohol moistening.

In printing machines liquid distributing rollers are known which are rotated by friction with adjoining rollers to transfer a dampening agent from a reservoir containing such an agent to an impression or form roller of the printing machine.

One of the conventional moistening systems of the type under consideration can be converted from the water moistening to the alcohol moistening. Such a system is disclosed in DE-AS No. 1,929,624. Moisture in this conventional system is transmitted by a vibrating or oscillating roller which conveys the moistening liquid from the fountain roller to the impression roller through material-transferring distributing rollers. If an alcohol supplement is to be used at least one plain roller is interchanged whereby the material-transferring roller serves as a storing roller on the rubbing roller.

This conventional device, in which the oscillating roller is positioned between the fountain roller and the rubbing roller has the disadvantage because, due to the various velocities of the rubbing roller, which rotates with the machine speed, and of the fountain roller which takes on the dampening agent from the reservoir and rotates considerably slower, the oscillating roller, which is in contact either with the fountain roller or with the rubbing roller, would be subjected to acceleration or decelation. Oscillating shocks caused by the above acceleration and decceleration on the rollers of the known moistening system have a negative effect on the ink-moistening agent balance which should be quickly achieved in the printing machine because during the application of the oscillating roller to the rubbing roller or the fountain roller an uncontrolled slippage between those two rollers during the transmittal of the moistening agent can occur.

Another known moistening system has been described in the German patent publication DD-PS No. 100 435. This system can also be suitable for the alcohol supplement. A suitable displacement means can be utilized in that known system to provide for a continuous or interrupted roller contact between the rubbing roller, oscillating roller and the doctor roller. In this case the oscillating roller takes on the wetting agent directly from the fountain roller. The disadvantage of this otherwise satisfactory system is that the different velocities of the wetting agent-distributing rollers occuring during the transmittal of the wetting agent result in the uncontrollable moistening.

SUMMARY OF THE INVENTION

It is, therefore, a general object of the present invention to overcome the aforementioned disadvantages of conventional moistening systems.

More particularly it is an object of the invention to provide an improved liquid distributing roller system which can be universally employed for water moistening and alcohol moistening.

It is still a further object of the invention to provide a moistening system for a printing machine in which an ink-wetting agent balance can be quickly achieved and in which paper waste can be reduced.

Still another object of the invention is to improve pressure quality in the roller system.

It is yet another object of the invention to provide a liquid distributing system which can be universally utilized and in which the peripheral velocity of the oscillating roller is always equal to the velocity of such a roller of the distributing roller system to which the oscillating roller is applied for taking on the liquid.

These and other objects of the invention are attained by a combined wetting agent-distributing system for a printing machine, applicable for water and for alcohol, including a rotatable fountain roller partially immersed in a reservoir containing a wetting liquid agent, and taking on the liquid agent therefrom, a vibrating roller, a rotatable rubbing roller, rotatable distributing rollers and a rotatable plate cylinder, said vibrating roller transmitting the liquid agent from said fountain roller to said rubbing roller which conveys the liquid agent through said distributing rollers to said plate cylinder, the system being further provided with a slippage roller interpositioned between said fountain roller and said vibrating roller, said slippage roller having a peripheral velocity equal in the value and direction to that of said rubbing roller.

In the case of water application the vibrating roller may be put into contact with said slippage roller in a cyclical fashion.

In the case of alcohol application the vibrating roller may be an intermediate roller interconnected between the slippage roller and the rubbing roller.

In accordance with a further feature of the invention the slipage roller may be connected to said rubbing roller by a toothed belt.

It is particularly advantageous that the arrangement of the invention favorably affects the dynamic condition of the moistening system.

DETAILED DESCRIPTION OF THE PREFERRED EMBODIMENTS

Figure 1:
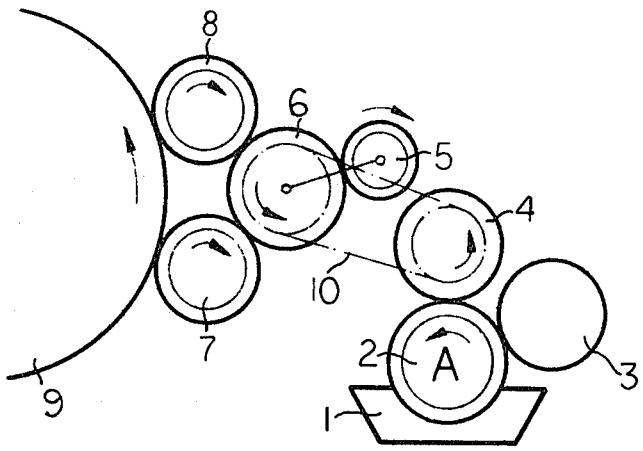
FIG. 1 is a schematic view of a moistening system according to the invention.

FIG. 1 illustrates an embodiment of the moistening system in which a vibrating roller is employed. The system comprises a reservoir 1 containing a wetting agent. A fountain roller 2 partially immersed into the reservoir 1 is in permanent contact with the wetting agent. A doctor roller 3 and a slipping or backlash roller 4 are rotated in contact with the fountain roller 2.

A vibrating roller 5 is rotated in constant contact with a rubbing roller 6 which presses against two distributing rollers 7 and 8 riding on an plate cylinder 9.

Figure 2:
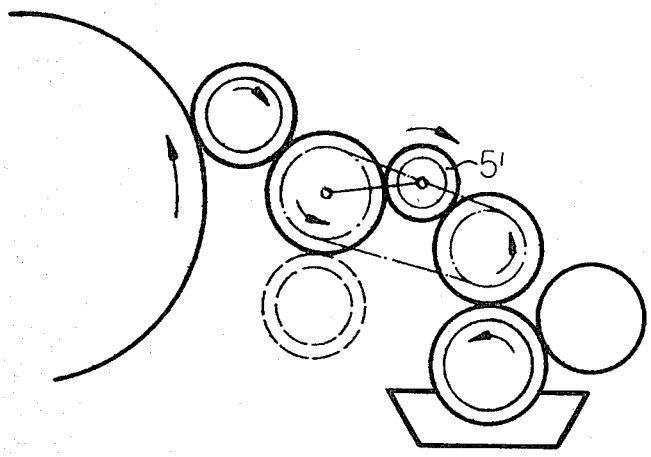
FIG. 2 is a schematic view of the moistening system of FIG. 1 but reversed for the alcohol-moistening.

In FIG. 2 illustrating the possibility of the application of the moistening system for alcohol moistening, the vibrating roller 5' is employed which is formed as an intermediate roller additionally applied onto the slipping roller 4. The plate cylinder 9 and the rubbing roller 6 are joined to each other by a known form-locking connection in the form of the gear connection. The slipping roller 4 is connected to the rubbing roller 6 by a toothed belt 10.

The operation of the moistening system is as follows:

Upon the rotation of the fountain roller 2 in the counter-clockwise direction as shown by arrow A the wetting agent from the reservoir 1 is applied onto the outer surface of roller 2 in the form of a film. The peripheral velocity of the fountain roller 2 is low as compared to the velocity of the printing machine. Doctor roller 3 mounted in contact with the fountain roller is driven by friction by the roller 2. The slipping roller 4 which is driven by the rubbing roller 6 through the toothed belt 10 is rotated with the machine velocity. Therefore, constant slippage continuously appears between the two rollers 4 and 2.

The vibrating roller 5 moves with respect to the rubbing roller 6 in the fashion described in the German patent publication DD-PS No. 117 844 and periodically comes into contact with the slipping roller 4 whereby the wetting agent is transferred from the slipping roller 4 to the rubbing roller 6.

Inasmuch as the peripheral velocities of the slipping roller 4 and the rubbing roller 6 are equal in the value and direction the vibrating roller 5 has also the same velocity during the operation whereby no velocity differences and thus uncontrolled moistening occur. Furthermore, undesired shock loads, which affect the operation of the whole roller system, are minimized or eliminated because the dragging of the fountain roller and the vibrating roller is avoided.

By means of the additionally reversed rubbing roller 6 and two distributing rollers 7, 8 is the wetting agent applied to the plate clamped to the plate cylinder 9 in the conventional manner and not shown in the drawing.

In addition, there is a possibility that the vibrating roller 5 will oscillate with respect to the slipping roller 4. In another modification, vibrating roller 5 can swing to and from between rollers 4 and 6.

In the modification of the system shown in FIG. 2 and suitable for the alcohol application, the vibrating roller is mounted between the rubbing roller 6 and the slipping roller 4 so that it is driven by friction therebetween.

The modified operation of the vibrating roller used for the alcohol application results through the shut down of the oscillating drive not shown herein and described in the German patent publication DD-PS No. 117844.

In the water-moistening modification the lower wiping roller 7 can be omitted or made inoperative through the plate cylinder 9.

In order to avoid ink sediments the peripheral velocities of the rollers are so graded that the plate cylinder has the lowest velocity because ink is first applied to the roller.

It will be understood that each of the elements described above, or two or more together, may also find a useful application in other types of moistening roller systems differing from the types described above.

While the invention has been illustrated and described as embodied in a moistening roller system for a printing machine, it is not intended to be limited to the details shown, since various modifications and structural changes may be made without departing in any way from the spirit of the present invention.

We claim:

1. In a combined wetting agent-distributing system for a printing machine, applicable for water and for alcohol, including a rotatable fountain roller partially immersed in a reservoir containing a wetting liquid agent, and taking on the agent therefrom, a vibrating roller, a rotatable rubbing roller rotated with a predetermined velocity, rotatable distributing rollers and a rotatable impression roller arranged in contact with said distributing rollers, said vibrating roller transmitting the agent to said rubbing roller which conveys the agent through said distributing rollers to said impression roller, said fountain roller being rotated with a peripheral velocity which is smaller than that of said rubbing roller, the improvement comprising a slipping roller interpositioned between said fountain roller and said vibrating roller, said slipping roller being in constant surface contact with said fountain roller and being rotated in a direction such that at the area of contact said slipping roller and said fountain roller are moving in opposite directions said rubbing roller being in constant surface contact with said distributing rollers and spaced from said slipping roller, said vibrating roller being interpositioned between said slipping roller and said rubbing roller means to move said vibrating roller about the axis of said rubbing roller and into and out of contact with said slipping roller, and means driving, said slipping roller from said rubbing roller so that said slipping roller has a peripheral velocity equal in the value and direction to that of said rubbing roller.

2. The distributing system as defined in claim 1, wherein in the case of water application said vibrating roller is put into contact with said slipping roller in a cyclical fashion.

3. The distributing system as defined in claim 1, wherein in the case of alcohol application said vibrating roller is an intermediate roller interconnected between said slipping roller and said rubbing roller.

4. The distributing system as defined in claim 1, wherein said predetermined peripheral velocity corresponds to the velocity of the printing machine.

* * * * *